US009193025B2

(12) United States Patent
Bhagavat et al.

(10) Patent No.: US 9,193,025 B2
(45) Date of Patent: Nov. 24, 2015

(54) SINGLE SIDE POLISHING USING SHAPE MATCHING

(71) Applicant: MEMC Electronic Materials, Inc., St. Peters, MO (US)

(72) Inventors: Sumeet S. Bhagavat, St. Charles, MO (US); Khiam How Low, St. Charles, MO (US); Ichiron Yoshimura, Utsunomiya (JP); John Allen Pitney, St. Charles, MO (US)

(73) Assignee: SunEdison Semiconductor Limited (UEN201334164H), Singapore (SG)

( * ) Notice: Subject to any disclaimer, the term of this patent is extended or adjusted under 35 U.S.C. 154(b) by 314 days.

(21) Appl. No.: 13/801,105

(22) Filed: Mar. 13, 2013

(65) Prior Publication Data

US 2014/0273748 A1 Sep. 18, 2014

(51) Int. Cl.

| | |
|---|---|
| ***B24B 49/10*** | (2006.01) |
| ***B24B 37/005*** | (2012.01) |
| ***B24B 49/03*** | (2006.01) |

(52) U.S. Cl.

CPC ..... *B24B 37/005* (2013.01); *B24B 49/03* (2013.01)

(58) Field of Classification Search

CPC ..... B24B 49/12; B24B 49/10
USPC ..... 451/5, 6, 41, 288, 289, 290, 8, 9, 10
See application file for complete search history.

(56) References Cited

U.S. PATENT DOCUMENTS

| | | | | |
|---|---|---|---|---|
| 5,599,423 | A | 2/1997 | Parker et al. | |
| 6,439,964 | B1 * | 8/2002 | Prahbu et al. | 451/8 |
| 6,468,131 | B1 * | 10/2002 | Korovin | 451/5 |
| 7,108,580 | B2 | 9/2006 | Ushio et al. | |
| 2002/0111122 | A1 * | 8/2002 | Korovin et al. | 451/41 |
| 2003/0060138 | A1 | 3/2003 | Hasegawa et al. | |
| 2009/0269861 | A1 | 10/2009 | Kurosawa | |

* cited by examiner

*Primary Examiner* — Robert Rose
(74) *Attorney, Agent, or Firm* — Armstrong Teasdale LLP

(57) ABSTRACT

A method of polishing a wafer is disclosed that includes determining a removal profile. The wafer is measured to determine a starting wafer profile and then the wafer is polished. The wafer is again measured after being polished to determine a polished wafer profile. The starting wafer profile and the polished wafer profile are compared to each other to determine the removal profile by computing the amount and shape of material removed from the first wafer during polishing.

20 Claims, 5 Drawing Sheets

SINGLE SIDE POLISHING USING SHAPE MATCHING

FIELD

This disclosure relates generally to polishing of semiconductor or solar wafers and more particularly to single side polishing apparatus and methods for controlling flatness of the wafer.

BACKGROUND

Semiconductor wafers are commonly used in the production of integrated circuit (IC) chips on which circuitry are printed. The circuitry is first printed in miniaturized form onto surfaces of the wafers. The wafers are then broken into circuit chips. This miniaturized circuitry requires that front and back surfaces of each wafer be extremely flat and parallel to ensure that the circuitry can be properly printed over the entire surface of the wafer. To accomplish this, grinding and polishing processes are commonly used to improve flatness and parallelism of the front and back surfaces of the wafer after the wafer is cut from an ingot. A particularly good finish is required when polishing the wafer in preparation for printing the miniaturized circuits on the wafer by an electron beam-lithographic or photolithographic process (hereinafter "lithography"). The wafer surface on which the miniaturized circuits are to be printed must be flat. Typically, flatness of the polished surfaces of the wafer are acceptable when a new polishing pad is used on the wafer, but the flatness becomes unacceptable as the polishing pad wears down over the course of polishing many wafers. Similarly, flatness and finish are also important for solar applications.

The construction and operation of conventional polishing machines contribute to the unacceptable flatness parameters. Polishing machines typically include a circular or annular polishing pad mounted on a turntable or platen for driven rotation about a vertical axis passing through the center of the pad. A polishing slurry, typically including chemical polishing agents and abrasive particles, is applied to the pad for greater polishing interaction between the polishing pad and the surface of the wafer. This type of polishing operation is typically referred to as chemical-mechanical polishing or simply CMP.

During operation, the pad is rotated and the wafer is brought into contact with the pad. As the pad wears, e.g., after a few hundred wafers, wafer flatness parameters degrade because the pad is no longer flat, but instead has a worn annular band forming a depression along the polishing surface of the pad. Such pad wear impacts wafer flatness, and may cause "dishing" or "doming".

As illustrated in FIG. 1, "doming", results in the wafer 50 having a generally convex polished surface 52. This results when the worn pad removes less material from the center of the front surface of the wafer 50 than from the areas closer to the wafer's edge 54. This is because the worn pad's removal rate is inverse to its wear. In other words, the portions of the worn pad with less wear remove more material than portions of the worn pad with more wear. The least amount of material is removed from the wafer 50 by the portion of the pad corresponding to the worn annular band. As a result, the polished wafer has a generally "domed" shape.

As illustrated in FIG. 2, "dishing" results in the wafer 60 having a generally concave shape. One potential reason for this occurring is that the polishing pad becomes embedded with abrasives (i.e., colloidal material from the slurry, debris from previously polished wafers, debris from a retaining ring) causing the removal rate to increase in the areas of wear. The portions of the pad with more wear remove more material from the wafer during the polishing process than portions of the pad with less wear. As a result, more material is removed from the center of the wafer 60 than from its edge 64 resulting in the polished surface 62 of the wafer having a generally "dished" shape.

When the flatness of the wafers becomes unacceptable (e.g., too "domed" or too "dished"), the worn polishing pad has to be replaced with a new one. Frequent pad replacement adds significant costs to the operation of the polishing apparatus not only because of the number of pads that need to be purchased, stored, and disposed of, but also because of the substantial amount of down time required to change the polishing pad.

Accordingly, there is a need for a polishing apparatus that has the ability to optimize flatness parameters by measuring one wafer before and after polishing to determine a removal profile and applying the removal profile to another wafer before polishing.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

A first aspect is a method of polishing a wafer. The method includes measuring a first wafer to determine a starting wafer profile, polishing the first wafer after determining the starting wafer profile, measuring the first wafer after polishing to determine a polished wafer profile, and then determining a removal profile by comparing the starting wafer profile and the polished profile to compute the amount and shape of material removed from the first wafer during polishing.

Another aspect is a method of predicting optimal orientation of a wafer with respect to an indexed polishing head in a polisher. The method includes measuring a first wafer to determine a starting profile, polishing the first wafer after the starting profile is determined, measuring the first wafer after polishing to determine a polished wafer profile. A removal profile of the first wafer is then calculated by superposing the starting profile with the polished wafer profile. A second wafer is measured to determine an initial profile. The removal profile of the first wafer is superposed on the initial profile of the second wafer to predict the shape of the second wafer after single side polishing to determine an initial predicted profile. Then a flatness parameter of the initial predicted profile is predicted.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Like reference symbols in the various drawings indicate like elements.

DETAILED DESCRIPTION

Generally, and in one embodiment of the present disclosure, a wafer that has previously been rough polished so that it has rough front and back surfaces is first subjected to an intermediate polishing operation in which the front surface of the wafer, but not the back surface, is polished to smooth the front surface and remove handling scratches. To carry out this operation, the wafer is placed on a turntable of a machine with the front surface of the wafer contacting the polishing surface of a polishing pad. A polisher head mounted on the machine is capable of vertical movement along an axis extending through the wafer. While the turntable rotates, the polisher head is moved against the wafer to urge the wafer toward the turntable, thereby pressing the front surface of the wafer into polishing engagement with the polishing surface of the polishing pad.

A conventional polishing slurry containing abrasive particles and a chemical etchant is applied to the polishing pad. The polishing pad works the slurry against the surface of the wafer to remove material from the front surface of the wafer, resulting in a surface of improved smoothness. As an example, the intermediate polishing operation preferably removes less than about 1 micron of material from the front side of the wafer.

The wafer is then subjected to a finish polishing operation in which the front surface of the wafer is finish polished to remove fine or "micro" scratches caused by large size colloidal silica (Syton) in the intermediate step and to produce a highly reflective, damage-free front surface of the wafer. The intermediate polishing operation generally removes more of the wafer than the finishing polishing operation. The wafer may be finish polished in the same single-side polishing machine used to intermediate polish the wafer as described above. However, it is understood that a separate single-side polishing machine may be used for the finish polishing operation. A finish polishing slurry having an ammonia base and a reduced concentration of colloidal silica is injected between the polishing pad and the wafer. The polishing pad works the finish polishing slurry against the front surface of the wafer to remove any remaining scratches and haze so that the front surface of the wafer is generally highly-reflective and damage free.

Figure 1:
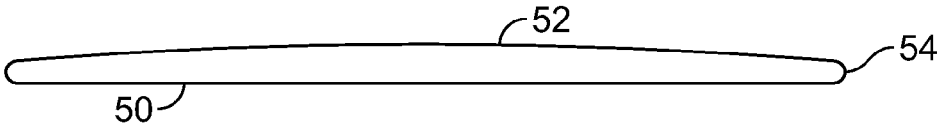
FIG. 1 is a cross section of a domed-shaped wafer.
Figure 2:
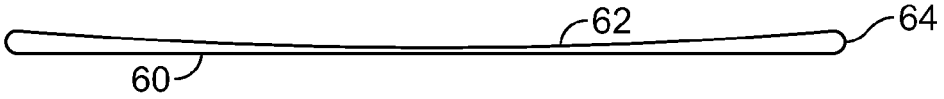
FIG. 2 is a cross section of a dish-shaped wafer.
Figure 3:
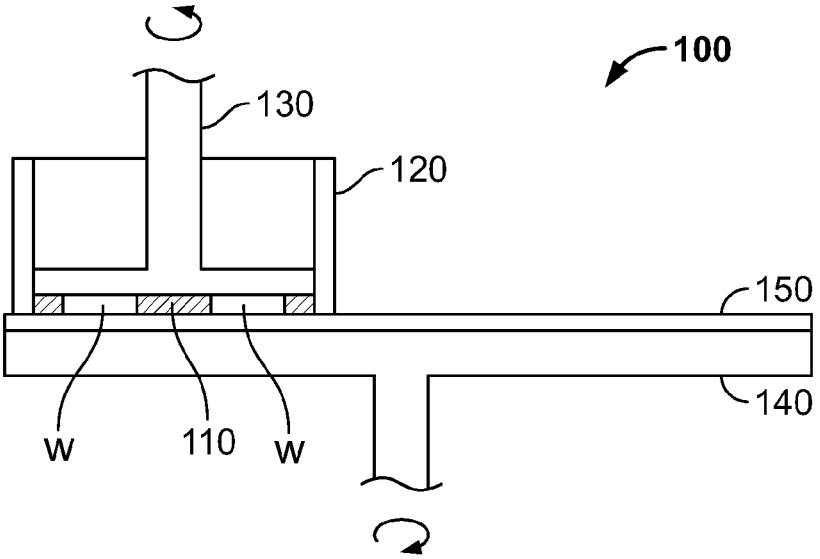
FIG. 3 is a partially schematic elevation of a single side polisher.

Referring to FIG. 3, a portion of a single side polishing apparatus is shown schematically and indicated generally at 100. The single side polisher is used to polish a front surface of semiconductor wafers W. It is contemplated that other types of single side polishing apparatus may be used.

The polishing apparatus 100 includes a generally annular wafer carrier 110 in a retainer 120. The wafer carrier 110 is located between a polishing head 130 and a turntable 140 having a polishing pad 150. The wafer carrier 110 has at least one circular opening to receive a wafer W to be polished therein. As discussed above, the polishing head 130 is capable of applying a vertical force to the wafer W to urge the wafer into the polishing pad 150 of the turntable 140.

The polishing head 130 and turntable 140 are rotated at selected rotation speeds by a suitable drive mechanism (not shown) as is known in the art. In some embodiments, the apparatus 100 includes a controller (not shown) that allows the operator to select rotation speeds for both the polishing head 130 and the turntable 140.

The polishing head 130 is always indexed such that when the head stops rotating about a rotational axis a marked point on the head will always return to the same location. A rotation angle, as discussed below, is the angle between this marked point and the notch of the wafer. There is no relative rotation between the wafer and the polishing head during polishing.

The lack of relative rotation enables the use of the rotation angle between the notch of the wafer and above mentioned marked point on the polishing head as a control parameter. As discussed below, this control parameter allows the superposition of the rotated removal profile on the wafer thickness profile resulting in the best shape matching to determine the optimal flatness.

In a method of one embodiment, a shape matching technique is used to optimize a flatness parameter of a front surface of a polished wafer. The method includes the steps of measuring a first wafer before and after polishing to determine a removal profile, and superposing the removal profile onto a second wafer to predict a polished profile and a flatness parameter for the second wafer.

Figure 4:
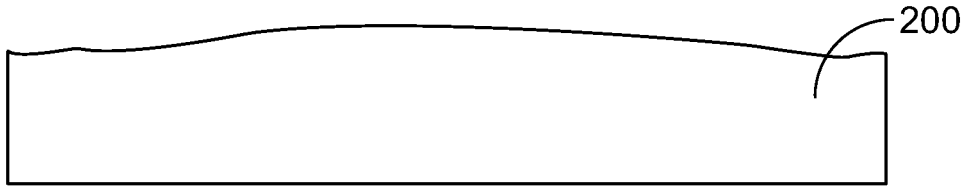
FIG. 4 is a cross section of a first wafer measured before a polishing process.
Figure 5:
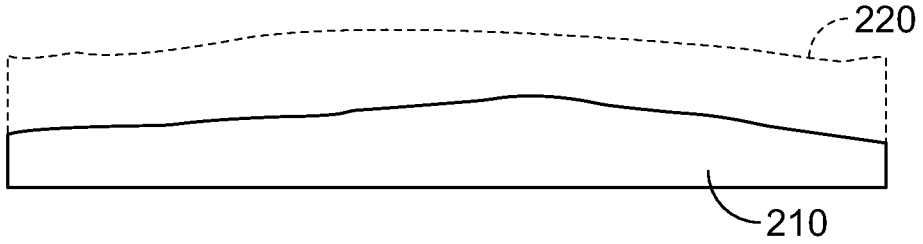
FIG. 5 is a cross section of the first wafer measured of FIG. 4 after a polishing process illustrating a removal profile.

With reference to FIG. 4, the first wafer is measured to determine a starting wafer profile 200. A system that is capable of determining wafer geometry is used to measure the wafer, such as a WaferSight tool manufactured by KLA Tencor. With reference to FIG. 5, the first wafer is then polished and measured again after polishing to determine a polished wafer profile 210. The removal profile 220 is determined by comparing the starting wafer profile 200 and the polished profile 210 to compute the amount and shape of material removed from the first wafer during polishing.

Figure 6:
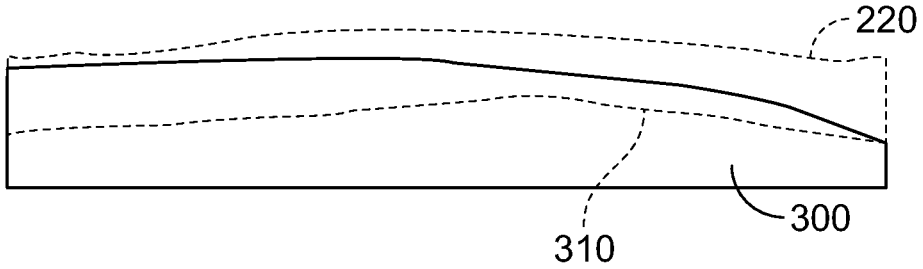
FIG. 6 is a cross section of a second wafer superposed with the removal profile of FIG. 4.

With reference to FIG. 6, the second wafer is measured to determine an initial profile 300, and an initial predicted profile 310 is determined by comparing the initial profile 300 of the second wafer in an initial orientation to the removal profile 220 of the first wafer. An initial predicted flatness parameter of an initial predicted polished surface from the initial predicted profile 310 is then determined. The flatness parameter may include one or more of the following: site backsurface-referenced ideal plane/range (SBIR), global backside indicated reading (GBIR), site frontside least squares focal plane range (SFQR), and edge flatness metric, sector based, front surface referenced, edge least squares fit reference plane (ES- FQR). However, other flatness parameters may be used within the scope of this disclosure.

In one embodiment, the notch of the wafer is rotated relative to the indexed polishing head to optimize flatness parameters. The use of this embodiment provides a method to predict the polished flatness parameters of an unpolished wafer using recently measured removal data for that polishing head. This embodiment also provides a method to optimize flatness parameters of a wafer after polishing using best shape matching.

This embodiment includes two sets of steps, a prediction set and an optimization set. A first step of the prediction set is measuring the profile of a first wafer before and after single side polishing of the first wafer. The difference between the 3D thickness data measured before and after single side polishing is calculated and the removal profile is calculated, as discussed above.

The profile of a second wafer is measured and an initial profile of the second wafer is determined before single side polishing. A subsequent predicted profile is determined by superposing the initial profile of the second wafer in an initial rotational orientation with the removal profile of the first wafer. Flatness parameters of a predicted polished surface of the subsequent predicted profile are calculated based on the predicted values of the predicted polished surface, as discussed above. In some embodiments, the removal profile is determined within approximately 300 minutes of processing the second wafer, though other time intervals may be used such as determining a new removal profile every approximately 180 minutes.

The first step of the optimization set includes angularly rotating one of the removal profile of the first wafer and initial profile of the second wafer with respect to the other. In some embodiments, the interval of rotation is approximately 5 degrees, though other intervals of rotation may be used, e.g., 1 degree, 10 degrees or other suitable interval. The removal profile and the initial profile are then superposed onto each other after the rotation to determine a subsequent or rotated predicted profile (not shown). A subsequent predicted flatness parameter is calculated for a subsequent predicted polished surface of the subsequent predicted profile. The subsequent predicted flatness parameter and initial flatness parameter of the second wafer are compared to determine a superior flatness parameter. The superior flatness parameter corresponds to the predicted profile having the flattest surface.

The removal profile is again rotated with respect to the initial profile at the interval and a predicted flatness parameter of a predicted polished surface is again calculated.

The predicted flatness parameters are then compared against one another to determine the optimal predicted flatness parameter and corresponding angle of rotation. The optimal predicted flatness may be determined using any number of optimization schemes. In some embodiments, the optimization schemes may include minimum SBIR rotation angle, minimum GBIR rotation angle, and GBIR above a certain limit pick rotation angle for minimum GBIR and minimum SBIR below a certain limit pick rotation angle.

The second wafer is placed into a polisher in the rotational orientation corresponding to the optimal flatness parameter and polished. The second wafer is again measured after polishing to determine a second polished wafer profile. A second removal profile is determined by comparing the initial profile of the second wafer to the second polished wafer profile to compute the amount and shape of material removed from the second wafer during the polishing process.

In the above single side polishing operations, the removal profile changes over time. Therefore, data for removal profiles for use in the above disclosed method are obtained frequently, e.g., every 180 minutes.

In one embodiment, the steps of the method disclosed above are automated. In this automated method, a computer processor (not shown) is connected with the polisher and the measuring device to provide hands free or automatic operation of the system. The computer processor receives the measurement data directly from the measuring device and performs the required calculations to determine the optimal angle of rotation. The computer processor then provides a signal to the polishing tool corresponding to the optimal angle of rotation. The polishing tool then indexes the wafer, or the polishing head, or both, with respect to each other before polishing the wafer.

The examples discussed below were processed on a Lapmaster LGP 708-XJ polisher, which uses surface tension to hold the wafers during polishing. In other embodiments, other means of holding the wafers during polishing may be used.

EXAMPLES

Figure 7:
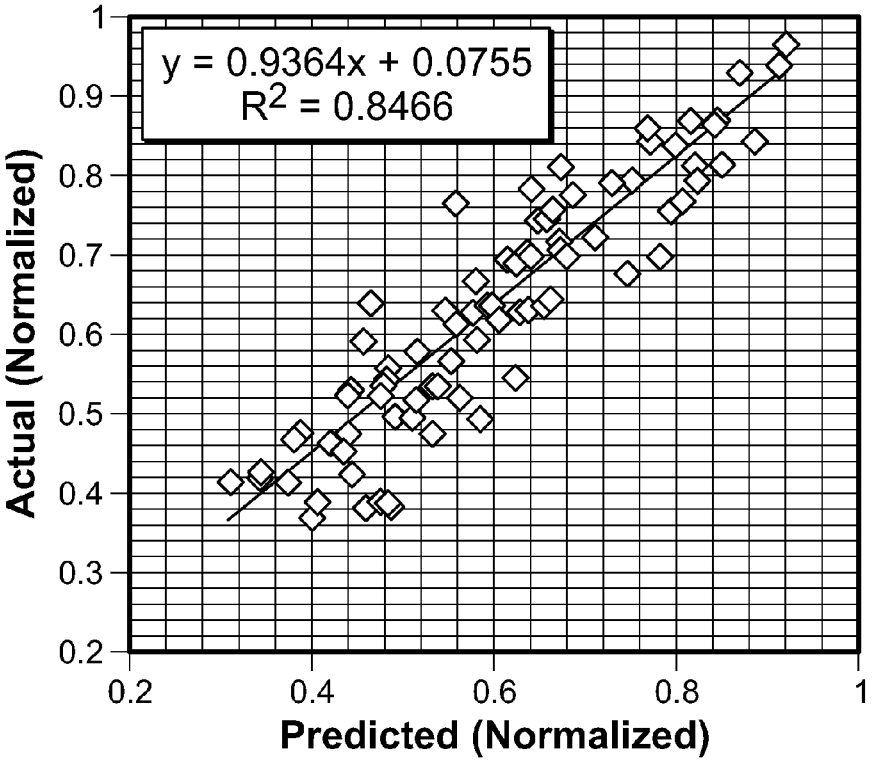
FIG. 7 is a graph plotting the correlation of the predicted SBIR and actual SBIR.
Figure 8:
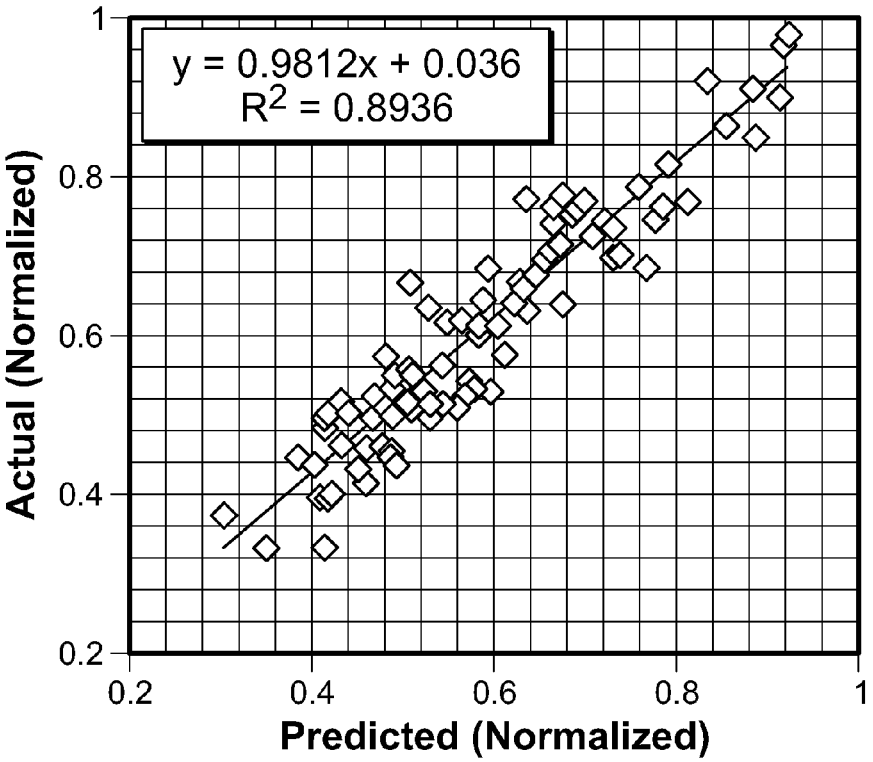
FIG. 8 is a graph plotting the correlation of the predicted GBIR and actual GBIR.
Figure 9:
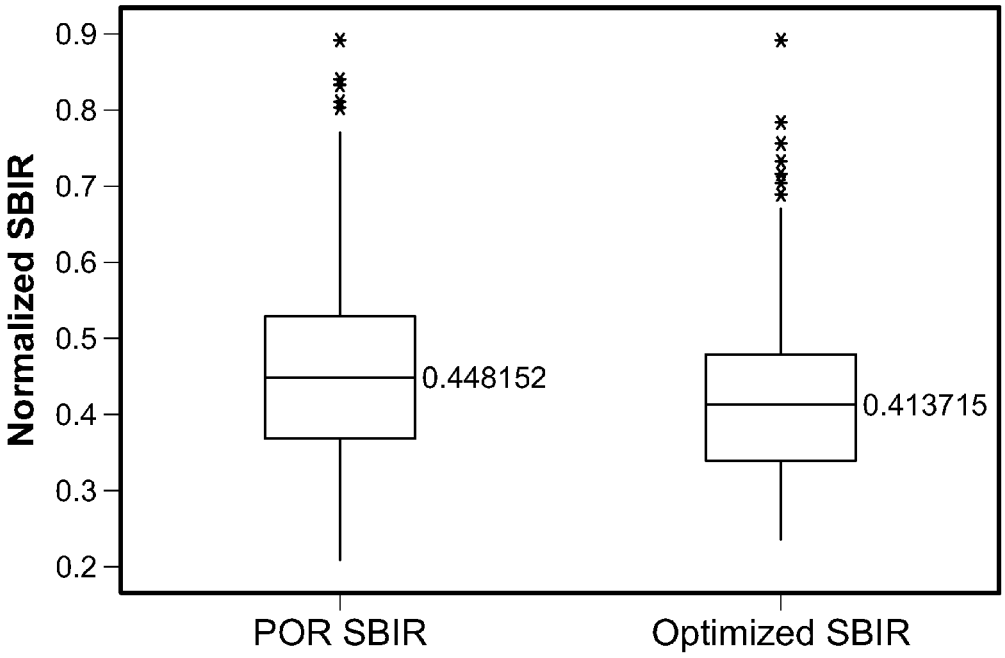
FIG. 9 is a boxplot of the improvement in Site Flatness Back Reference Ideal Range when the angle of wafer rotation is chosen to optimize Site Flatness Back Reference Ideal.
Figure 10:
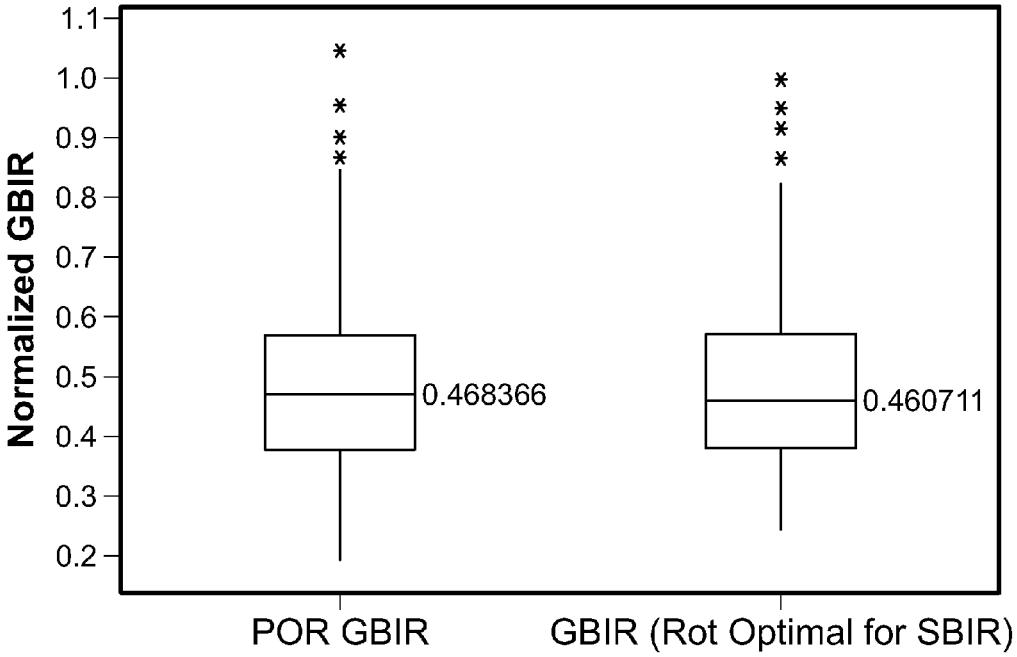
FIG. 10 is a boxplot of the improvement in Site Flatness Back Reference Ideal Range when the angle of wafer rotation is chosen to optimize Global Backside Ideal Focal Plane Range.
Figure 11:
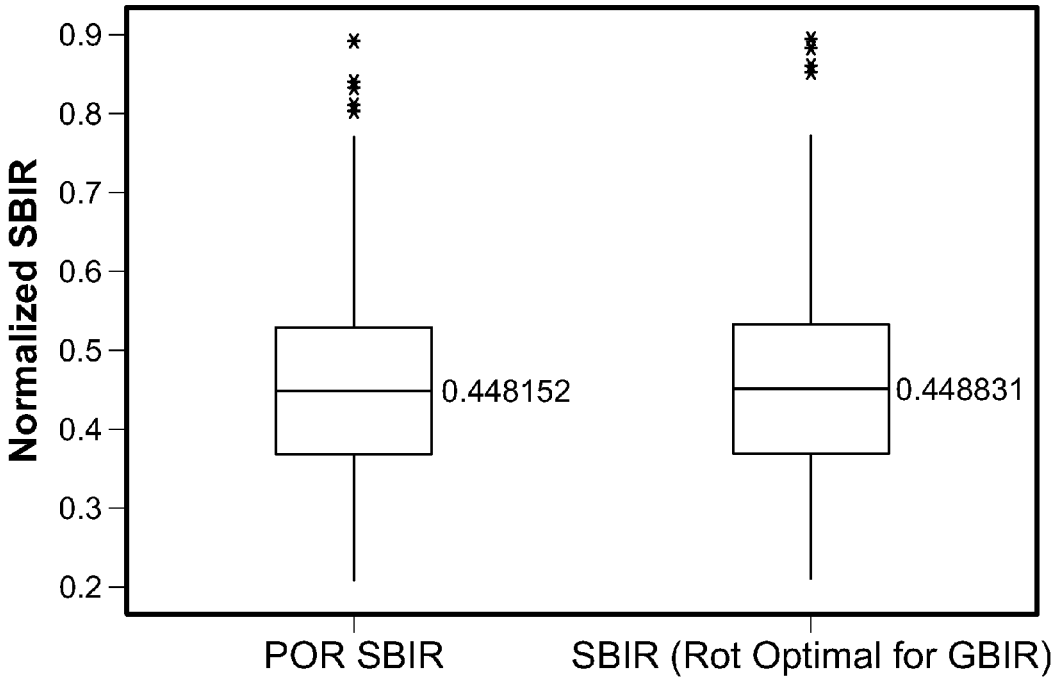
FIG. 11 is a boxplot of the improvement in Global Backside Ideal Focal Plane Range when the angle of wafer rotation is chosen to optimize Site Flatness Back Reference Ideal Range.
Figure 12:
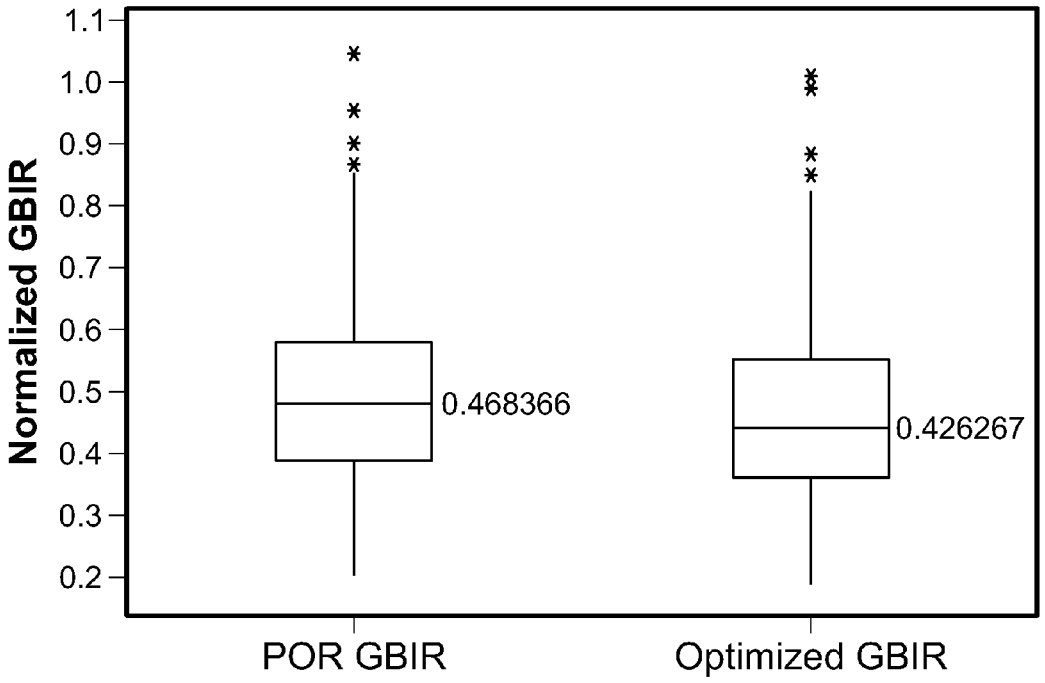
FIG. 12 is a boxplot of the improvement in Global Backside Ideal Focal Plane Range when the angle of wafer rotation is chosen to optimize Global Backside Ideal Focal Plane Range.

With reference to FIGS. 7 and 8, plots of the correlation between the predicted SBIR and actual SBIR are shown. The removal profiles for these results were obtained based on a first wafer processed on the polisher less than 300 minutes before processing of the second wafer. FIG. 9 shows the improvement in SBIR when the rotational angle of the wafer is chosen to optimize SBIR. FIG. 10 shows the impact of choosing the rotational angle of the wafer for optimizing SBIR on the GBIR values. FIG. 11 shows the impact of choosing the rotational angle of the wafer for optimizing GBIR on the SBIR values. FIG. 12 shows the improvement in GBIR when the rotational angle of the wafer is chosen to optimize GBIR.

The embodiments described herein enable an efficient and economical polishing method of processing semiconductor wafers. The method improves wafer yield and process capability, while reducing product tolerances and the time needed for maintenance associated with the replacement of the polishing pads and templates mounted on the single side polishing head.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements. The use of terms indicating a particular orientation (e.g., "top", "bottom", "side", "down", "up", etc.) is for convenience of description and does not require any particular orientation of the item described.

As various changes could be made in the above constructions and methods without departing from the scope of the invention, it is intended that all matter contained in the above description and shown in the accompanying drawing[s] shall be interpreted as illustrative and not in a limiting sense.

What is claimed is:

1. A method of polishing a wafer, the method comprising:

measuring a first wafer to determine a starting wafer profile;

polishing the first wafer after determining the starting wafer profile;

measuring the first wafer after polishing to determine a polished wafer profile;

determining a removal profile by comparing the starting wafer profile and the polished profile to compute the amount and shape of material removed from the first wafer during polishing;

measuring a second wafer to determine an initial profile;

determining an initial predicted profile by comparing the initial profile of the second wafer to the removal profile of the first wafer; and determining an initial predicted flatness parameter of an initial predicted polished surface from the initial predicted profile.

2. The method of claim 1, further comprising the steps of:

determining a rotated predicted profile by rotating the initial profile with respect to the removal profile and comparing the initial profile in a rotated orientation to the removal profile of the first wafer; and determining a rotated predicted flatness parameter of a rotated predicted polished surface from the rotated predicted profile.

3. The method of claim 2, wherein the flatness parameter is selected from the group consisting of SBIR, GBIR, SFQR, and ESFQR.

4. The method of claim 2, wherein the initial profile is rotated with respect to the removal profile at an angle of approximately 5 degrees.

5. The method of claim 2, further comprising the step of:

determining a superior flatness parameter by comparing the initial predicted parameter and the rotated predicted flatness parameter.

6. The method of claim 5, further comprising repeating the steps of determining a rotated predicted profile, determining a rotated predicted flatness parameter, and determining a superior flatness parameter for additional rotated orientations to determine an optimal flatness parameter.

7. The method of claim 6, further comprising the step of placing the second wafer into a polisher in the rotational orientation corresponding to the optimal flatness parameter.

8. The method of claim 7, further comprising the step of polishing the second wafer.

9. The method of claim 8, further comprising the steps of:

measuring the second wafer after polishing to determine a second polished wafer profile; and determining a second removal profile by comparing the initial profile of the second wafer to the second polished wafer profile to compute the amount and shape of material removed from the second wafer during the polishing process.

10. A method of processing a wafer with respect to an indexed polishing head in a polisher, the method comprising:

measuring a first wafer to determine a starting profile;

polishing the first wafer after the starting profile is determined;

measuring the first wafer after polishing to determine a polished wafer profile;

calculating the removal profile of the first wafer by superposing the starting profile with the polished wafer profile measuring a second wafer to determine an initial profile;

superposing the removal profile of the first wafer on the initial profile of the second wafer to predict the shape of the second wafer after single side polishing to determine an initial predicted profile and; and predicting a flatness parameter of the initial predicted profile.

11. The method of claim 10, further comprising the step of obtaining the removal profile within 300 minutes of processing the second wafer.

12. The method of claim 10, wherein the flatness parameter is selected from the group consisting of SBIR, GBIR, SFQR, and ESFQR.

13. The method of claim 10, wherein the flatness parameter includes a combination of at least two flatness parameters selected from the group consisting of SBIR, GBIR, SFQR, and ESFQR.

14. The method of claim 10, further comprising the step of calculating the optimal rotation of a wafer relative to the polishing head to optimize the flatness parameter.

15. The method of claim 10, further comprising the step of indexing the rotational head according to the optimal rotational angle.

16. The method of claim 10, further comprising the step of optimizing the predicted flatness parameters by determining the rotation angle of the indexed polishing head to provide optimal flatness parameters.

17. The method of claim 10, further comprising the step of polishing the second wafer.

18. The method of claim 10, further comprising the step of:

measuring the second wafer after polishing to determine a second polished wafer profile; and determining a second removal profile by comparing the initial profile of the second wafer to the second polished wafer profile to compute the amount and shape of material removed from the second wafer during the polishing process.

19. A method of polishing a wafer, the method comprising:

measuring a first wafer to determine a starting wafer profile;

polishing the first wafer after determining the starting wafer profile;

measuring the first wafer after polishing to determine a polished wafer profile;

measuring a second wafer to determine an initial profile; and placing the second wafer into a polisher in a rotational orientation corresponding to a provided optimal flatness parameter, wherein the provided optimal flatness parameter and the corresponding rotational orientation are based on:

a removal profile determined by comparing the starting wafer profile and the polished profile to compute the amount and shape of material removed from the first wafer during polishing;

an initial predicted profile determined by comparing the initial profile of the second wafer in an initial relational orientation to the removal profile of the first wafer;

an initial predicted flatness parameter of an initial predicted polished surface determined from the initial predicted profile;

a rotated predicted profile determined by rotating the initial profile with respect to the removal profile and comparing the initial profile in a rotated orientation to the removal profile of the first wafer;

a rotated predicted flatness parameter of a rotated predicted polished surface determined from the rotated predicted profile;

a superior flatness parameter determined by comparing the initial predicted parameter and the rotated predicted flatness parameter; and an iteration of determining a rotated predicted profile, determining a rotated predicted flatness parameter, and determining a superior flatness parameter for additional rotated orientations to determine the optimal flatness parameter.

20. The method of claim 19, wherein the flatness parameter is selected from the group consisting of SBIR, GBIR, SFQR, and ESFQR.

* * * * *